US007238072B1

(12) United States Patent
Phillips et al.

(10) Patent No.: US 7,238,072 B1
(45) Date of Patent: Jul. 3, 2007

(54) MOUNTING SYSTEM FOR A MARINE ENGINE

(75) Inventors: George E. Phillips, Oshkosh, WI (US); Derric Drake, Stillwater, OK (US); Benjamin C. Wald, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/377,018

(22) Filed: Mar. 16, 2006

(51) Int. Cl.
*B63H 21/30* (2006.01)

(52) U.S. Cl. ..... 440/111; 440/112

(58) Field of Classification Search ..... 440/111, 440/112

See application file for complete search history.

(56) References Cited

U.S. PATENT DOCUMENTS

| | | | | |
|---|---|---|---|---|
| 3,722,456 | A | 3/1973 | Lambrecht et al. | 115/41 R |
| 3,929,089 | A | 12/1975 | Lambrecht et al. | 115/41 HT |
| 5,129,479 | A | 7/1992 | Fujii et al. | 180/297 |
| 5,450,922 | A | 9/1995 | Doi et al. | 180/297 |
| 5,478,264 | A | 12/1995 | Law | 440/111 |
| 5,634,832 | A | 6/1997 | Nakase et al. | 440/88 |
| 6,027,384 | A | 2/2000 | Nitta et al. | 440/75 |
| 6,029,638 | A * | 2/2000 | Funai et al. | 123/572 |
| 6,322,409 | B1 * | 11/2001 | Hattori et al. | 440/88 R |
| 6,386,309 | B1 | 5/2002 | Park | 180/300 |
| 6,390,863 | B1 | 5/2002 | Imanaga | 440/53 |
| 6,415,884 | B1 | 7/2002 | Hawener et al. | 180/291 |
| 6,645,019 | B1 | 11/2003 | Shiomi et al. | 440/52 |
| 7,014,519 | B1 | 3/2006 | Batten et al. | |
| 2003/0017768 | A1 * | 1/2003 | Gokan | 440/111 |

* cited by examiner

*Primary Examiner*—Sherman Basinger
(74) *Attorney, Agent, or Firm*—William D. Lanyi

(57) ABSTRACT

A support system for a marine engine provides a plurality of mounts that have primary axes that are aligned in parallel relation with a piston symmetry plane of the engine. These primary axes of the mounts are also aligned with the central axes of the cylinders of the engine. This arrangement improves the damping function of the mounts and more effectively isolates engine vibrations from the marine vessel.

16 Claims, 9 Drawing Sheets

MOUNTING SYSTEM FOR A MARINE ENGINE

BACKGROUND OF THE INVENTION

1. Field of the Invention

The present invention is generally related to a mounting system for a marine engine and, more particularly, to a mounting system for a four cylinder in-line engine that is tilted, or slanted, within the structure of a marine vessel.

2. Description of the Related Art

Those skilled in the art of marine propulsion systems are aware of various different methods for supporting an engine in relation to a marine drive unit, such as a sterndrive device. These support techniques typically involve a plurality of mounts which attach the marine engine to the marine vessel. The mounts typically comprise a metallic structure that is combined with an elastomeric material for the purpose of supporting the marine engine in such a way that vibrations are damped and prevented from being transmitted directly to the marine vessel structure.

U.S. Pat. No. 3,722,456, which issued to Lambrecht et al. on Mar. 27, 1973, describes a sterndrive unit propeller trimming arrangement. The system comprises a boat hull and a sterndrive unit which includes and is supported by an engine and which further includes a marine propulsion lower unit tiltable vertically and swingable horizontally independently of the engine, together with means mounting the sterndrive unit on the boat hull including means for selectively vertically displacing or tilting the forward end of the engine relative to the rear of the engine.

U.S. Pat. No. 3,929,089, which issued to Lambrecht et al. on Dec. 30, 1975, describes a sterndrive hydraulic trim control system including a tilt position indicator. The unit includes a sterndrive leg fixed to the rear of an engine and including a part which is tiltable vertically and swingable horizontally independently of the engine. It includes a rearwardly located elastomeric mount connected to the sterndrive unit and adapted for connection to a boat hull for vibrationally isolating and supporting the sterndrive unit from the boat hull. It also provides a pivotal axis relative to which the sterndrive unit is tiltable relative to the boat hull, an elastomeric part, a bracket fixed to the elastomeric part and adapted to be fixed to the boat hull, an arm fixed to the elastomeric part remotely from the bracket, and a jacking mechanism connected between the engine and the arm for tilting the sterndrive unit relative to the boat hull while also supporting and vibrationally isolating the engine from the boat hull.

U.S. Pat. No. 5,129,479, which issued to Fujii et al. on Jul. 14, 1992, describes a suspension system for an engine and transmission assembly mounted transversely in a vehicle. It has a main axis of moment of inertia extending in a left and right direction of the vehicle, a single first mount located at a first end of the engine and transmission assembly and at least one additional mount located in the vicinity of an opposite second end of the assembly. The center of gravity of the assembly is located on a main axis of moment of inertia of the assembly extending between the first and second ends and is closer to the first end than to the second end.

U.S. Pat. No. 5,450,922, which issued to Doi et al. on Sep. 19, 1995, describes an automobile power plant mounting structure. The power plant is mounted on both sides in a transverse direction by mounts. Each of the mounts is placed within a triangle defined by a point on a primary inertial axis of the power plant on the transverse side of the power plant.

U.S. Pat. No. 5,478,264, which issued to Law on Dec. 26, 1995, describes a marine engine mounting system which includes a vibration absorbing assembly for mounting a marine engine to a stringer. It includes a mounting bracket adapted for attachment to the marine engine, a base adapted for attachment to a stringer, and first and second resilient vibration absorbing members supported within the mounting bracket and selectively connected to the base. The first resilient member is relatively more resistant in a horizontal direction for cushioning horizontal thrust loads acting upon the bracket with respect to the base.

U.S. Pat. No. 5,634,832, which issued to Nakase et al. on Jun. 3, 1997, describes an induction system for a four-cycle watercraft engine. Various induction system configurations adapt a four-cycle multi-cylinder engine for use in small personal watercrafts. This is accomplished by canting the engine at an angle to a vertically extending plane and positioning the induction system on the upper portion of the cylinder head.

U.S. Pat. No. 6,027,384, which issued to Nitta et al. on Feb. 22, 2000, describes a four-cycle engine for a small jet boat. The engine is provided which is suitable for use in a vehicle or an apparatus such as a small jet boat to be operated on the premise that it often overturns. An oil pan is disposed below the bottom of a crankcase, the spaces and the components are communicated with each other via a communicating hole which is formed in the bottom of the crankcase.

U.S. Pat. No. 6,386,309, which issued to Park on May 14, 2002, describes a mount assembly for an automotive power plant. The mounting structure for a vehicle includes an engine side mount assembly, a transmission side mount assembly, and front and rear mount assemblies. The engine side mount assembly includes a mount which is less stiff in the front and rear directions than in the upward and downward directions of the vehicle and is arranged such that an axis of the mount is parallel to an inertial axis of a moment of inertia of the power plant.

U.S. Pat. No. 6,390,863, which issued to Imanaga on May 21, 2002, describes an outboard motor which includes an engine holder, an engine disposed above the engine holder in a state wherein the outboard motor is mounted to a hull, a mount unit including upper and lower mount devices for mounting the outboard motor to the hull and a bracket through which the upper and lower mount devices are mounted to the hole.

U.S. Pat. No. 6,415,884, which issued to Hawener et al. on Jul. 9, 2002, describes a suspension system for a drive assembly of a motor vehicle. The drive assembly is secured above a subframe to a separate cross member by way of two engine mounts, with a third mount being provided on a transmission housing or on a distributor drive. The cross member is secured separately and rigidly to the subframe at the vehicle body.

U.S. Pat. No. 6,645,019, which issued to Shiomi et al. on Nov. 11, 2003, describes an outboard engine system. An inertia force generated longitudinally by a piston is countervailed by an inertia force generated by a crankshaft and inertia forces laterally generated vibrate a body of the outboard engine system laterally about a phantom center point of vibration. An elastomeric member resiliently supporting the system body on a hull has a rigidity in a tangent direction about the phantom center point of vibration.

U.S. Pat. No. 7,014,519, which issued to Batten et al. on Mar. 21, 2006, discloses a marine propulsion system with a tilted in-line engine. The engine is disposed at a tilted angle relative to a vertical plane in order to reduce the maximum height requirement space of an engine compartment of a marine vessel. The crankshaft axis of the in-line engine can be located on a vertical vessel symmetry plane or can be offset from it. The crankshaft of the in-line engine can be disposed parallel to the vessel symmetry plane, within the vessel symmetry plane, or perpendicular to the vessel symmetry plane.

The patents described above are hereby expressly incorporated by reference in the description of the present invention.

SUMMARY OF THE INVENTION

A marine propulsion system made in accordance with a preferred embodiment of the present invention comprises an engine having a plurality of cylinders, a marine propulsion device connected in torque transmitting relation with the crankshaft, and a plurality of mounts attached to the engine. Each of the plurality of cylinders has an associated one of a plurality of central axes disposed within a piston symmetry plane. The engine comprises a crankshaft supported for rotation about a crankshaft axis which is also disposed within the piston symmetry plane. The engine is supported to dispose the piston symmetry plane at a preselected angle relative to a vertical plane. The preselected angle is greater than zero degrees and less than ninety degrees. Each of the plurality of mounts has a primary axis and each of the primary axes is disposed in parallel association with the piston symmetry plane.

The engine is supported by the plurality of mounts in a marine vessel and in a preferred embodiment, the plurality of mounts comprises first and second mounts which are attached to a rear portion of the engine and a third mount which is attached to a front portion of the engine. A bearing is configured to support a driveshaft of the marine propulsion system. A support axis extends between the bearing and the third mount. The bearing is supported by a transom of the marine vessel and the support axis extends generally through a center of gravity of the engine. In a particularly preferred embodiment of the present invention, the bearing is a gimbal bearing. The bearing is aligned with the crankshaft axis and the first and second mounts are spaced apart from, and on opposite sides of, the piston symmetry plane. The third mount is disposed within the piston symmetry plane in one of several alternative embodiments of the present invention. The preselected angle, between the piston symmetry plane and a vertical plane is between forty-five and fifty-five degrees in a preferred embodiment of the present invention. The plurality of cylinders comprises four cylinders which are disposed within the piston symmetry plane in a preferred embodiment of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
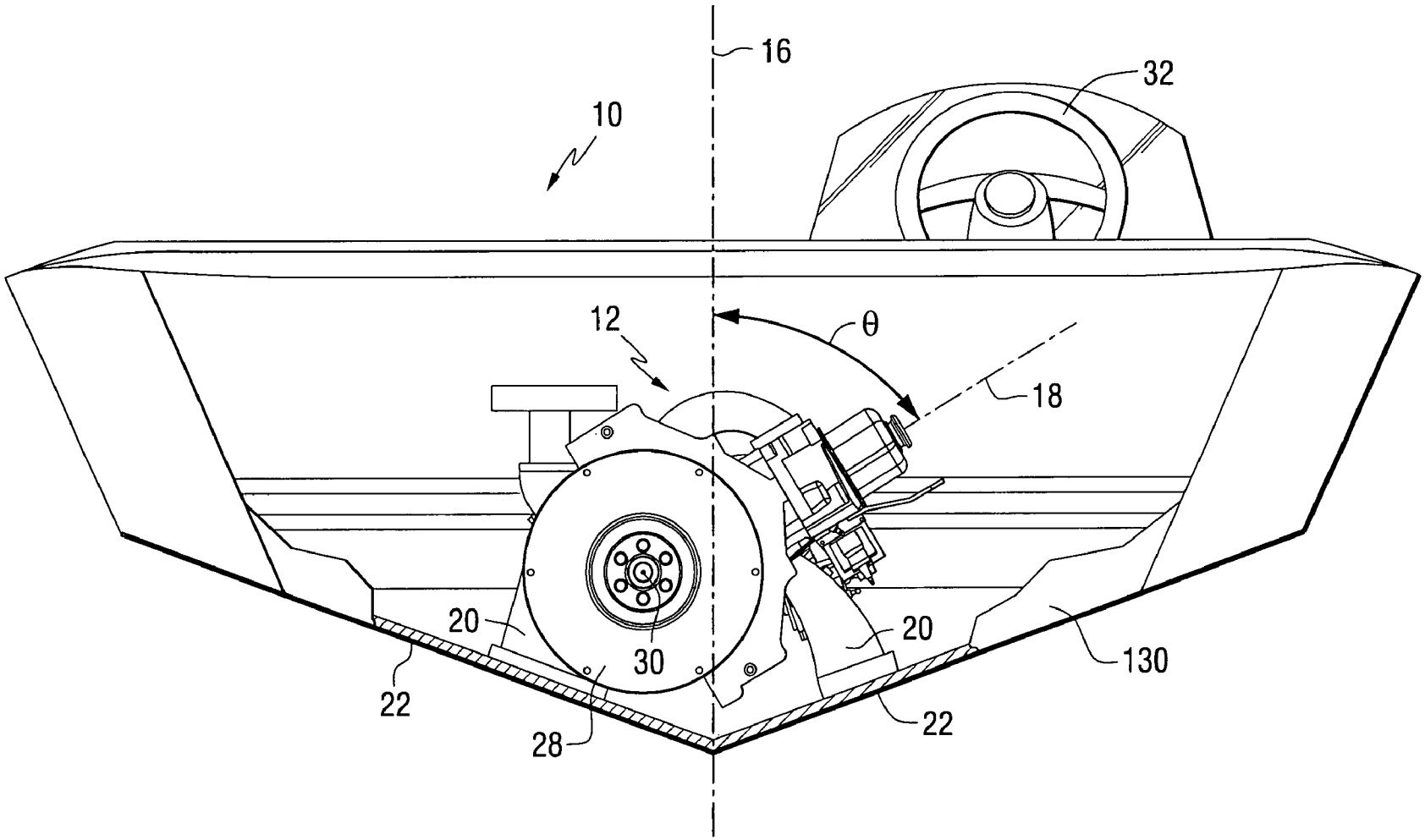
FIG. 1 PRIOR ART
FIG. 1 illustrates a marine vessel with a tilted marine engine supported therein.

Throughout the description of the preferred embodiment of the present invention, like components will be identified by like reference numerals.

FIG. 1 shows a marine vessel 10 with an engine 12 that is slanted, or tilted, as represented by angle θ between a vertical plane 16 and a piston symmetry plane 18. The engine 12 is an in-line engine in which all of the cylinders and pistons have central axes disposed within the piston symmetry plane 18. In a particularly preferred embodiment of the present invention, the engine 12 is a four cylinder in-line engine.

With continued reference to FIG. 1, support structures 20 are attached to a bottom surface 22 of the marine vessel 10 and to the engine 12. As will be described in greater detail below, the present invention relates to the arrangement of a plurality of mounts which are connected between the support structures 20 and the engine 12.

With continued reference to FIG. 1, a flywheel 28 is attached to a crankshaft of the engine 12 for rotation about a crankshaft axis 30. The slanted, or tilted, engine 12 is described in greater detail within the Batten et al. patent described above. FIG. 1 is a rear view of the marine vessel 10 showing the engine 12 tilted toward the right, or starboard, side of the marine vessel 10. The steering wheel 32 of the boat represents the helm location. It should be understood that the engine 12 could alternatively be tilted toward the left if this provides an advantage either in spatial considerations or to better balance the load within the marine vessel 10.

Figure 2:
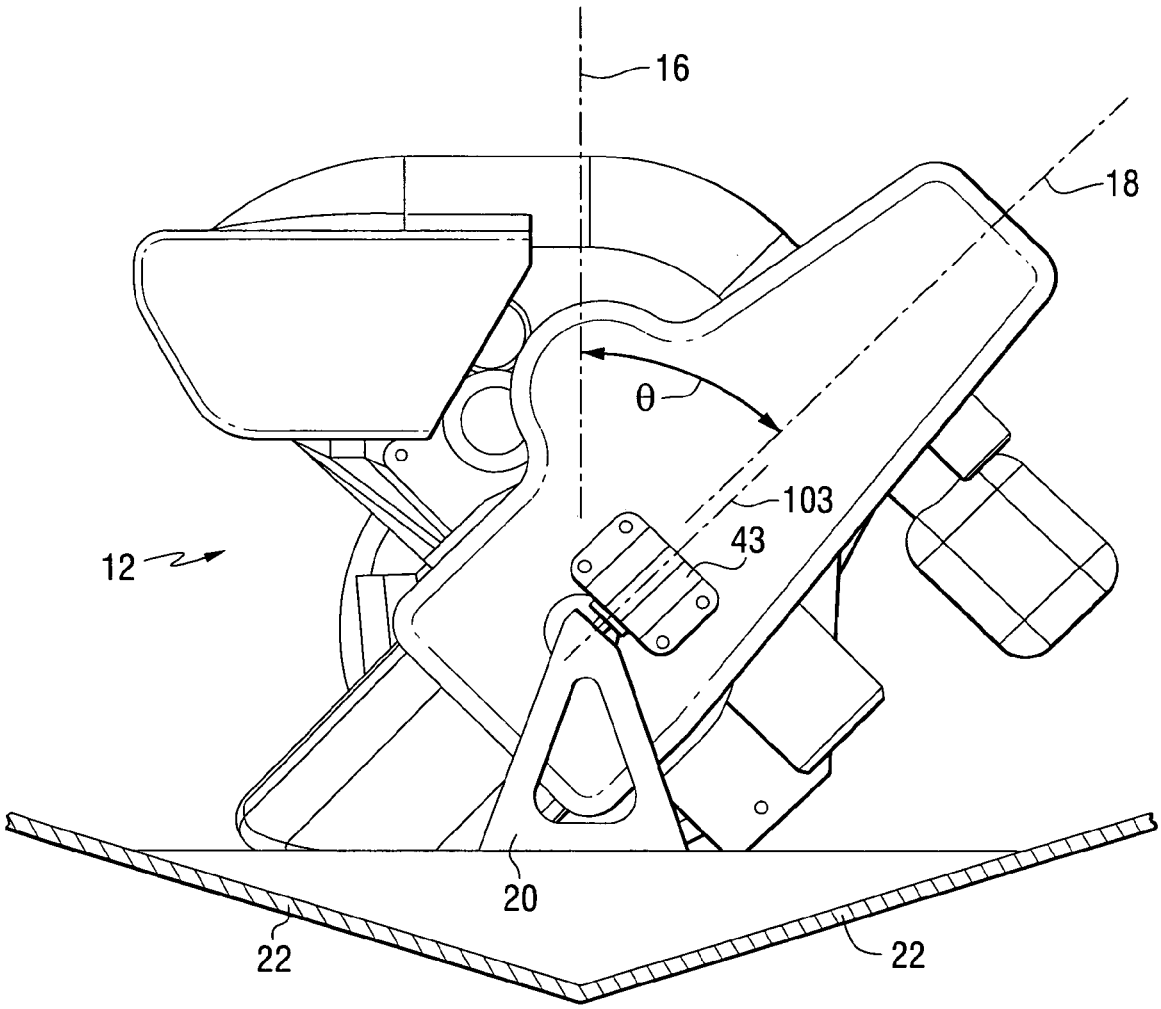
FIG. 2 is a front view of an engine incorporating the concepts of the present invention.
Figure 3:
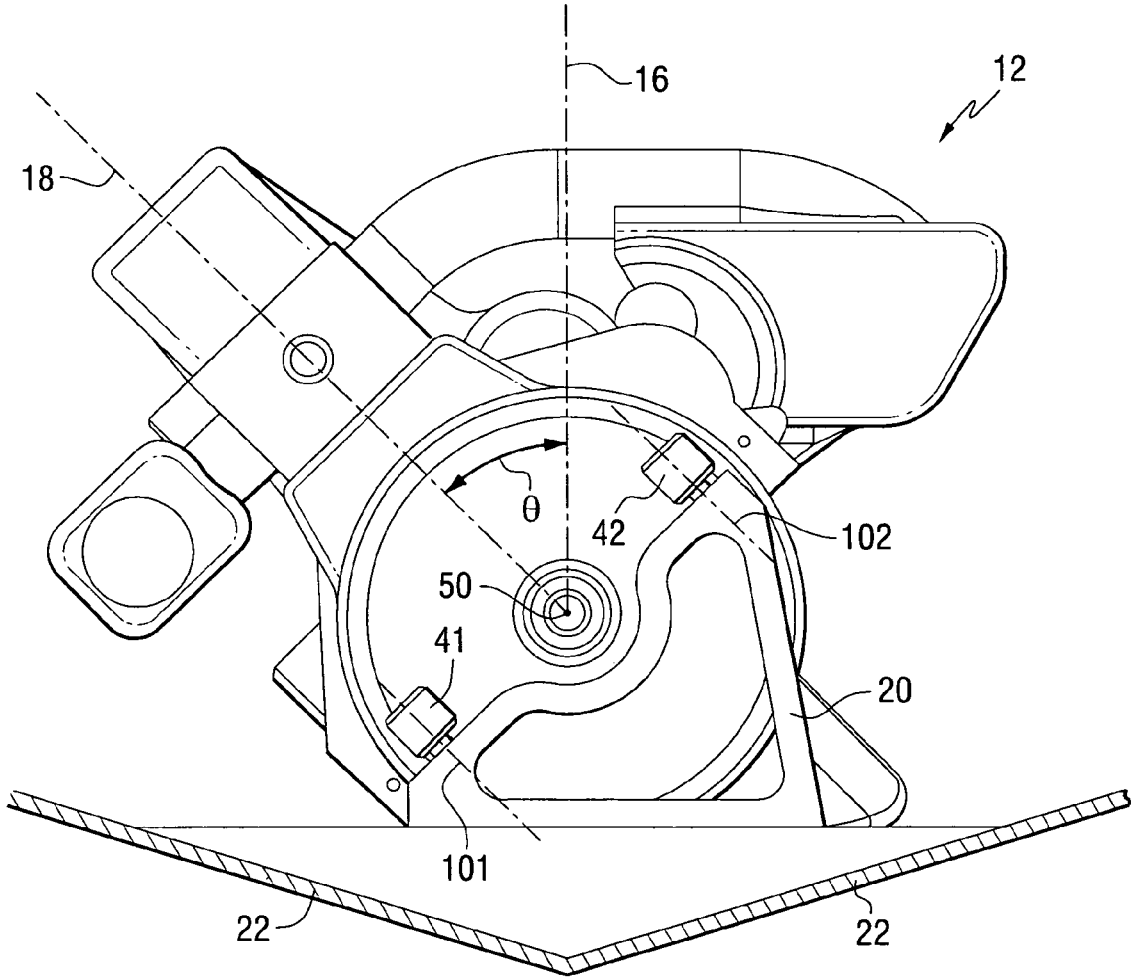
FIG. 3 is a rear view of the engine illustrated in FIG. 2.

FIG. 2 is a front view of an engine 12 supported according to the principals of the present invention. The support structure 10 is attached to the marine vessel, represented by the bottom surface 22 in FIG. 2, in the manner described above in conjunction with FIG. 1. The piston symmetry plane 18 is disposed at an angle θ from a vertical plane 16. FIG. 3 is a rear view of the engine 12 shown in FIG. 2. In FIGS. 2 and 3, it can be seen that the piston symmetry plane 18 of the engine 12 is disposed at an angle θ from a generally vertical plane 16. In FIG. 3, the support structure 20 is configured to support two mounts, 41 and 42, and in FIG. 2, the support structure 20 is configured to support a third mount 43. The first and second mounts, 41 and 42, are attached to a rear portion of the engine 12 and the third mount 43 is attached to a front portion of the engine 12. Reference numeral 50 identifies the crankshaft axis of the engine. As can be seen, the crankshaft axis 50 is within the piston symmetry plane 18.

FIGS. 2 and 3, described above, represent front and rear views of the engine 12. As will be described below, FIGS. 4-9 are various views of projected images of relevant planes and lines associated with different embodiments of the present invention. It should be understood that the specific locations of the mounts, 41-43, in FIGS. 2 and 3 do not precisely match their locations and positions in FIGS. 4-9. It should also be understood that the positions of the mounts, 41-43, in FIGS. 2-9 are intended to be exemplary and are not limiting to the scope of the present invention.

Figure 4:
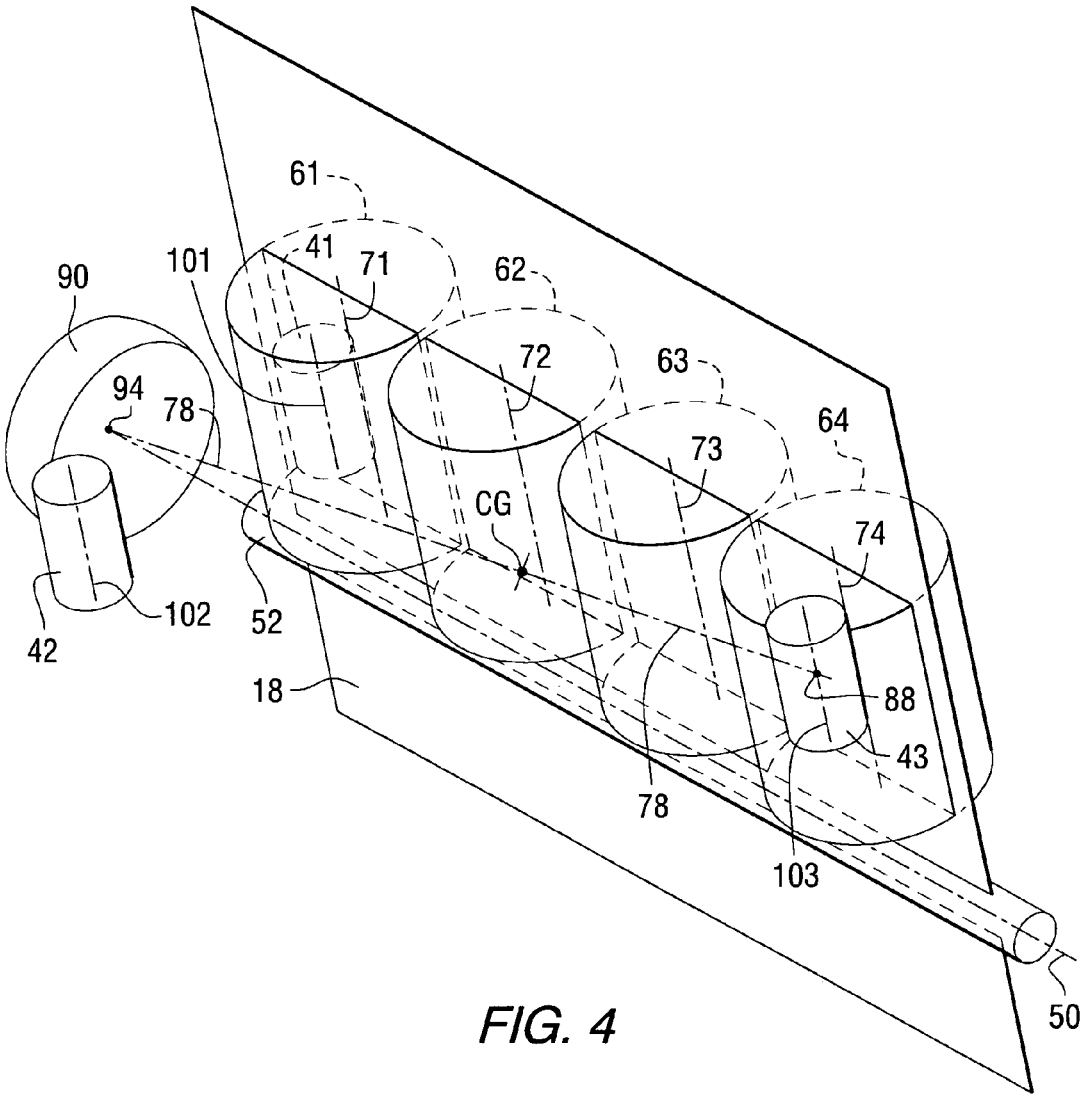
FIG. 4 is an isometric view of a projected arrangement of components of the present invention to illustrate their spatial relationships.

FIG. 4 is a highly schematic representation of the piston symmetry plane 18, the first and second mounts, 41 and 42, and the third mount 43. The crankshaft 52 is shown in coaxial association with its crankshaft axis 50. The components in FIG. 4 are intentionally shown in a highly schematic representation to illustrate the spatial relationships between the various components and imaginary planes and axes. Four cylinders, 61-64, are shown with their associated central axes, 71-74. The piston symmetry plane 18 is defined by the four central axes, 71-74, which all lie in the piston symmetry plane 18. In addition, the crankshaft axis 50 is disposed within the piston symmetry plane 18. In order to further describe the spatial relationships between the components shown in FIG. 4, a support axis 78 is shown extending through a primary axis 103 of the third mount 43, as represented by point 88. The support axis 78 also extends through the center of gravity CG of the engine. A bearing 90 is illustrated in FIG. 4. In a preferred embodiment of the present invention, the bearing 90 is a gimbal bearing that is supported by the transom of a marine vessel. The crankshaft axis 50 and the support axis 78 intersect within the structure of the gimbal bearing 90, as represented by point 94.

With continued reference to FIG. 4, it should be understood that the center of gravity CG of the engine is not always within the piston symmetry plane 18. As a result, intersect point 88 within the third mount 43 is displaced from the piston symmetry plane 18. In addition, notwithstanding the schematic representation of FIG. 4, it should also be understood that the piston symmetry plane 18 is not a vertical plane but, instead, is disposed at an angle θ from a vertical plane 16, as described above in conjunction with FIGS. 2 and 3. This relationship is shown more clearly in the top view of FIG. 5.

Figure 5:
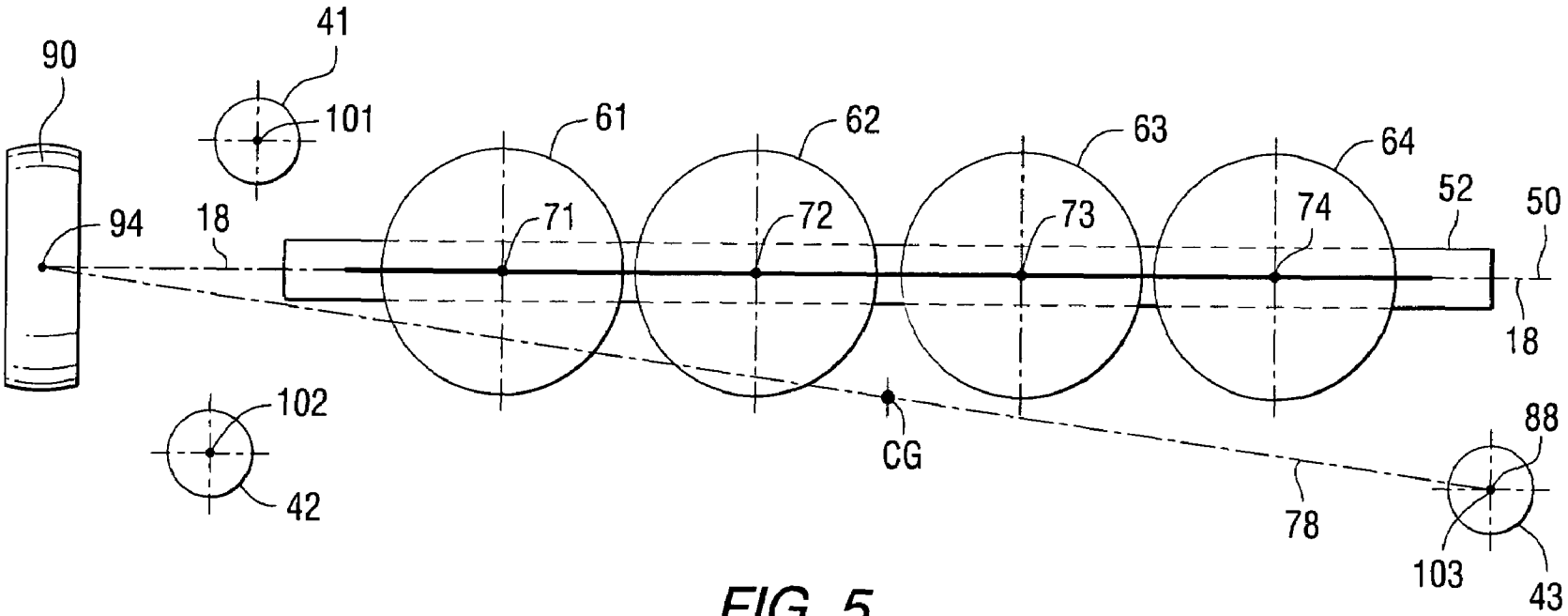
FIG. 5 is a top view of the projected arrangement shown in FIG. 4.

With continued reference to FIGS. 4 and 5, it can be seen that the center of gravity CG is displaced from the piston symmetry plane 18. Because the crankshaft axis 50 extends through the bearing 90 and intersects the support axis 78 at point 94, this relationship places the third mount 43 at a point 88 which is also displaced from the piston symmetry plane 18.

Each of the three mounts, 41-43, has a primary axis. These primary axes are identified by reference numerals 101-103 in FIGS. 4 and 5. These primary axes are also identified in FIGS. 2 and 3.

With continued reference to FIGS. 2-5, it can be seen that the engine 12 has a plurality of cylinders, 61-64, and each of the cylinders has an associated one of a plurality of central axes, 71-74. The central axes are disposed within the piston symmetry plane 18. The engine also comprises a crankshaft 52 supported for rotation about a crankshaft axis 50 which is disposed within the piston symmetry plane 18. A marine propulsion device, which is represented by the bearing 90, is connected in torque transmitting relation with the crankshaft 52 and the piston symmetry plane 18 is disposed at a preselected angle θ relative to a vertical plane 16. The preselected angle θ is greater than zero degrees and less than ninety degrees and, in a particularly preferred embodiment of the present invention, is generally within the range of forty-five to fifty-five degrees. In certain particularly preferred embodiments of the present invention, angle θ is generally equal to fifty degrees. A plurality of mounts, 41-43, is attached to the engine 12. Each of the primary axes, 101-103, is disposed in parallel association with the piston symmetry plane 18. In a particularly preferred embodiment of the present invention, each of the primary axes is also disposed in parallel association with each of the central axes, 71-74, of the cylinders, 61-64. The arrangement of the primary axes, 101-103, relative to the piston symmetry plane 18 and the central axes, 71-74, of the cylinders, 61-64, is that the forces caused by the reciprocating pistons within the cylinders are more effectively damped by the mounts, 41-43, than would be possible if the mounts were disposed with their primary axes, 101-103, in a generally vertical configuration or in a configuration which placed those primary axes in a symmetrical relationship with the vertical plane 16.

Figure 6:
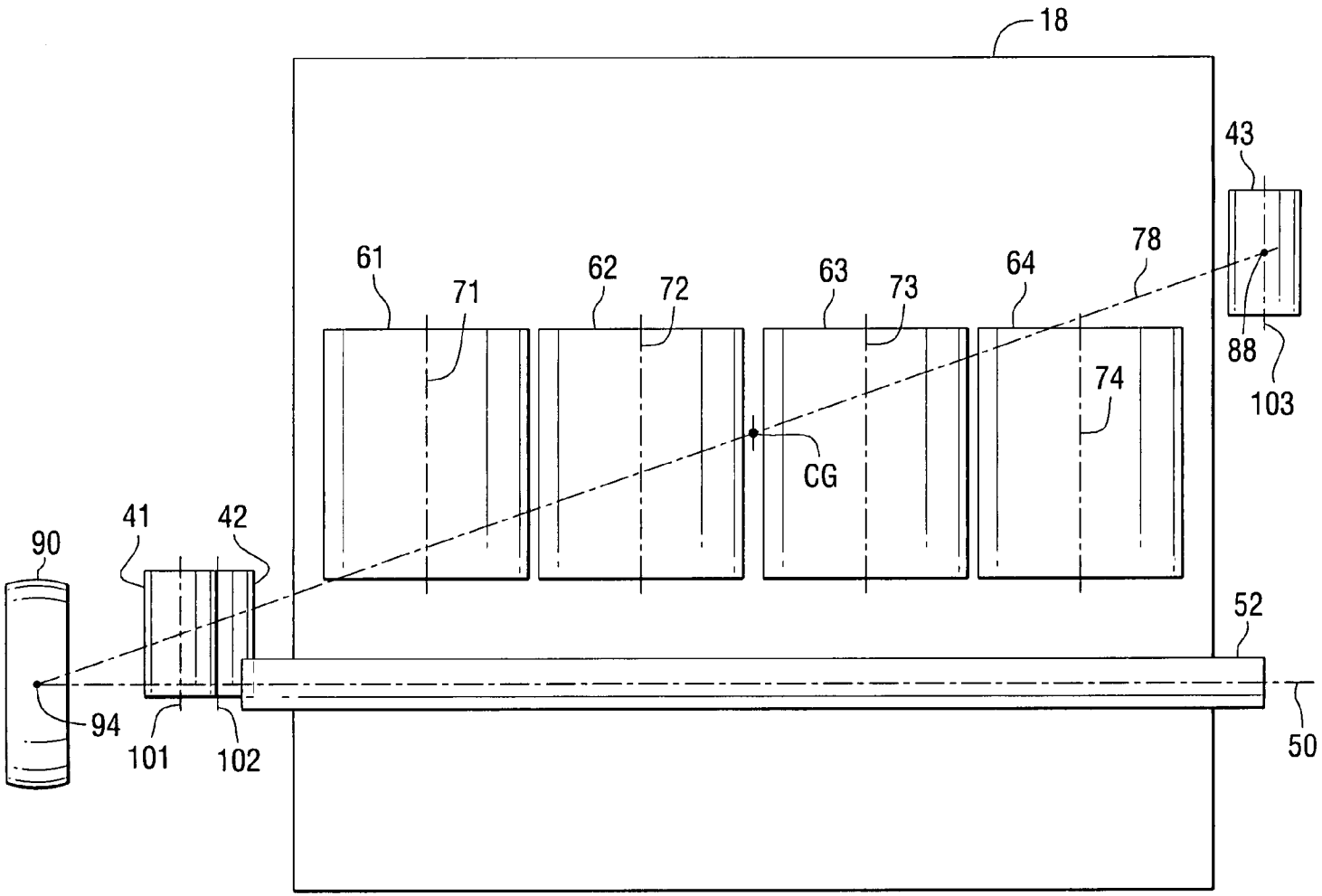
FIG. 6 is a side view of the projected arrangement shown in FIG. 4.

FIG. 6 is a side view of the same arrangement described above in conjunction with FIGS. 4 and 5. The four cylinders, 61-64, are illustrated with their four central axes, 71-74. The support axis 78 is shown extending through the center of gravity CG, the point 88 on the primary axis 103 of the third mount 43 and the intersection point 94 with the crankshaft axis 50 which is within the bearing 90. FIGS. 4-6 show an embodiment of the present invention in which the third mount 43 is displaced from the piston symmetry plane 18 because of the location of the center of gravity CG relative to the piston symmetry plane.

Figure 7:
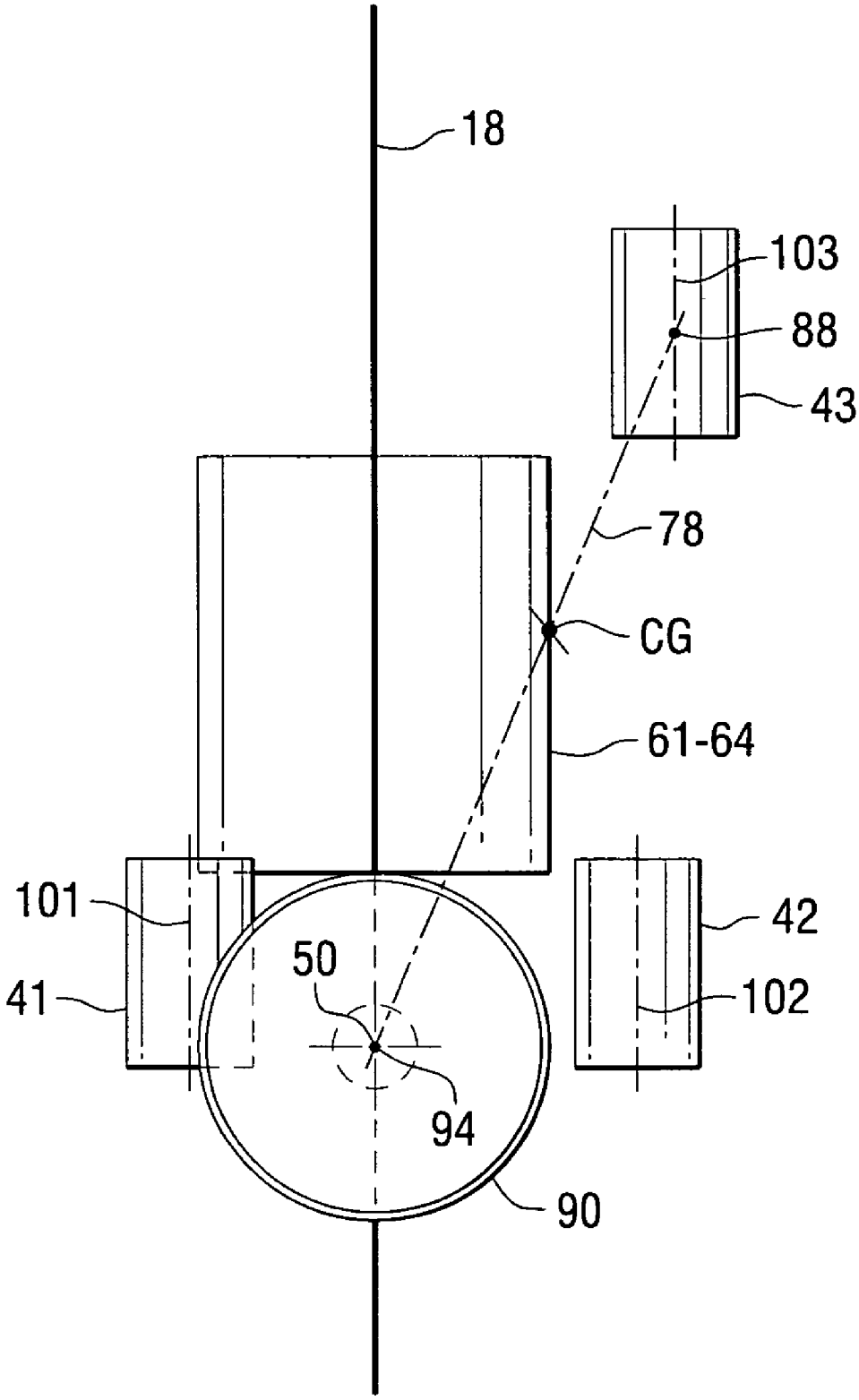
FIG. 7 is a rear view of the arrangement shown in FIG. 4.

FIG. 7 is a rear view of the arrangement described above in conjunction with FIGS. 4-6. The third mount 43 is shown above the location of the first and second mounts, 41 and 42. The support axis 78 extends between the intersect point 94 with the crankshaft axis 50 and the intersect point 88 with the primary axis 103 of the third mount 43. The center of gravity CG is illustrated in FIG. 7 as being displaced from the piston symmetry plane 18. The four cylinders, 61-64, are also shown in FIG. 7. One characteristic of the present invention that is illustrated in FIGS. 4-7 is the parallel relationship between the primary axes, 101-103, of the three mounts, 41-43, with both the piston symmetry plane 18 and the central axes, 71-74, of the four cylinders, 61-64. Notwithstanding the tilted relationship of the piston symmetry plane 18 with respect to a vertical plane 16, as described above in conjunction with FIGS. 1-3, the arrangement of the mounts in a preferred embodiment of the present invention provides an efficient and effective damping of the vibrations caused by the reciprocal motion of pistons within the cylinders, 61-64, which are in a direction parallel to the central axes, 71-74, of those cylinders.

Figure 8:
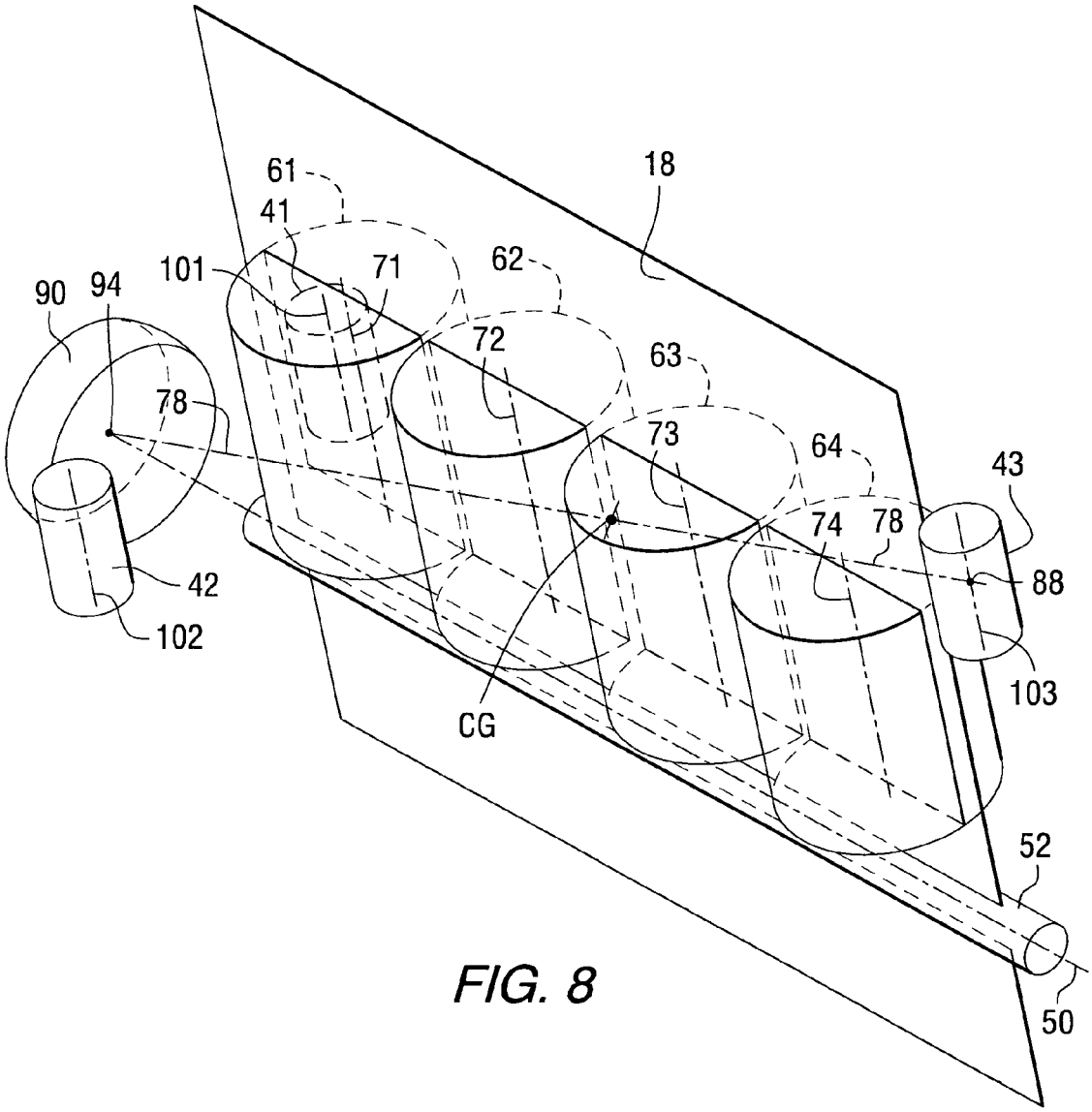
FIG. 8 is an isometric view of an alternative arrangement of the present invention.

FIG. 8 is generally similar to FIG. 4, but with the center of gravity CG located within the piston symmetry plane 18. This change with respect to the system shown in FIG. 4 causes the third mount 43 to be located with its primary axis 103 within the piston symmetry plane 18. This also places the support axis 78 within the piston symmetry plane 18.

Figure 9:
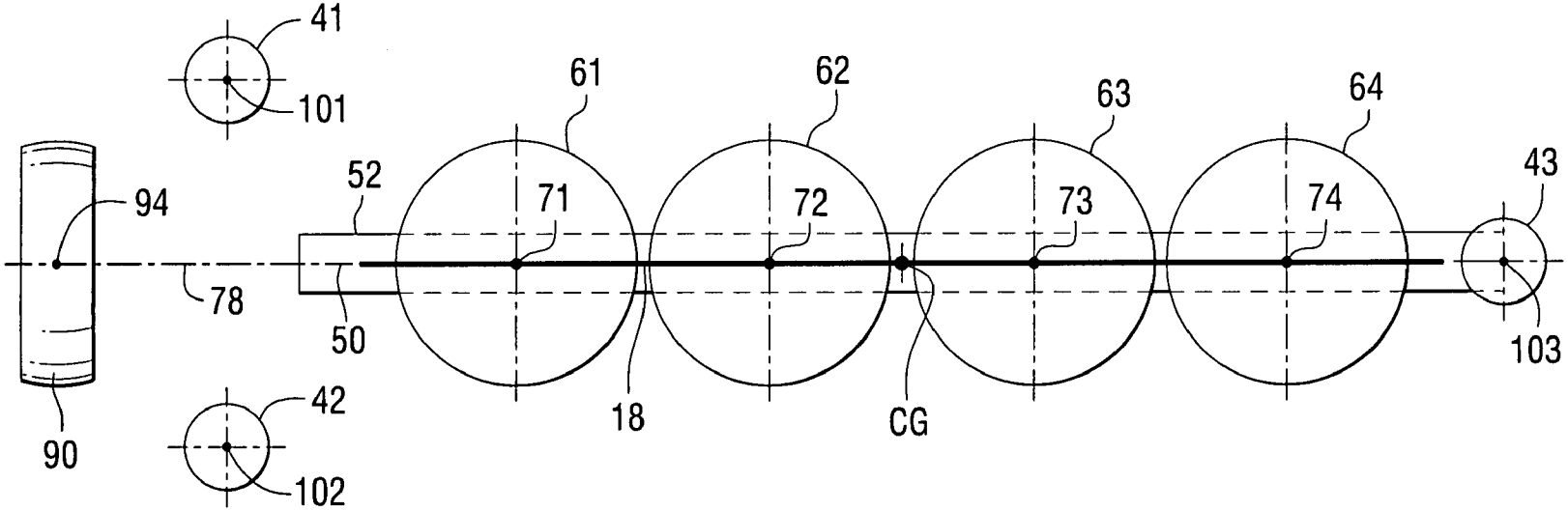
FIG. 9 is a top view of the projected arrangement shown in FIG. 8.

FIG. 9 is a top view of the arrangement shown in FIG. 8. The central axes, 71-74, of the four cylinders, 61-64, are disposed within the piston symmetry plane 18 which, in FIG. 9, is coincident with the crankshaft axis 50 and the support axis 78. The crankshaft and support axes, 50 and 78, intersect at point 94 within the gimbal bearing 90. The center of gravity CG is also located within the piston symmetry plane 18.

It should be understood that the piston symmetry plane 18 illustrated in FIGS. 4-9, is disposed at an angle θ relative to a vertical plane 16. The piston symmetry plane 18 is illustrated in FIGS. 4-9 as appearing to be generally vertical. However, it should be understood that this physical arrangement is used to more clearly show the relationship between the various components, lines, and planes in these figures. Rather than being generally vertical, as illustrated in FIGS. 4-9, the piston symmetry plane 18 is intended to be disposed at an angle θ, as illustrated in FIGS. 1-3, in all embodiments of the present invention. Angle θ, in a particularly preferred embodiment of the present invention, is approximately fifty degrees. In certain embodiments of the present invention, angle θ is between forty-five and fifty-five degrees, and in all embodiments of the present invention it is greater than zero degrees and less than ninety degrees, relative to a vertical plane 16.

With references to FIGS. 2-9, it can be seen that a preferred embodiment of the present invention comprises an engine 12 having a plurality of cylinders, 61-64, in which each of the plurality of cylinders has an associated one of a plurality of central axes, 71-74. The plurality of central axes is disposed within a piston symmetry plane 18. The engine 12 comprises a crankshaft 52 which is supported for rotation about a crankshaft axis 50 which is disposed within the piston symmetry plane 18. A marine propulsion device is connectable in torque transmitting relation with the crankshaft 52 and the engine 12 is supported to dispose the piston symmetry plane 18 at a preselected angle θ relative to a vertical plane 16. The preselected angle θ is greater than zero degrees and less than ninety degrees. A plurality of mounts, 41-43, is attached to the engine 12 and each of the plurality of mounts has a primary axis, 101-103. Each of the primary axes is disposed on parallel association with the piston symmetry plane 18 and attached to both the engine 12 and the marine vessel 10 to support the engine. In a preferred embodiment of the present invention, the plurality of mounts comprises first and second mounts, 41 and 42, attached to a rear portion of the engine 12 and a third mount 43 attached to a front portion of the engine 12. A gimbal bearing 90 is supported by a transom 130 of the marine vessel 10 and configured to support a driveshaft of the marine propulsion system. A support axis 78 extends between the gimbal bearing 90 and the third mount 43. The support axis 78 extends through a center of gravity CG of the engine 12. The gimbal bearing 90 is generally aligned with the crankshaft axis 50. Throughout the description of the preferred embodiment of the present invention and in the figures, the gimbal bearing 90 represents the marine propulsion device, such as a sterndrive. Those skilled in the art are aware of the relationship between the gimbal bearing 90 and the other components of a sterndrive device. The actual sterndrive device, which is typically supported by the transom and behind the transom, is not shown in the figures in order to more clearly describe the physical and spatial relationship between the gimbal bearing 90, the piston symmetry plane 18, the crankshaft axis 50, and the support axis 78.

Throughout the description of the preferred embodiment of the present invention, the term "primary axis" is used in relation to the mounts, 41-43, to define an axis along which the mount is designed to support, or react to, a load provided by the device (e.g. the engine 12) which is intended to be supported by the mounts. Those skilled in the art of engine mount configurations are aware of many different types of mounts that can be used for these purposes. The mounts typically comprise a metallic portion and an elastomeric portion. The relationship between the metallic and elastomeric portions of a mount are typically arranged to define one or more axes that are most suitable for supporting and damping a load which can often be a vibration load. Many types of mounts have two or more such axes. Often, a mount can support a load efficiently and economically and effectively damp vibrations along a primary or principal axis and also along an axis which is generally perpendicular to the primary or principal axis. In that case, the use of the term "principal axis" in the description of the present invention is intended herein to mean either the central axis which best damps such a load or possibly another axis perpendicular to the principal or primary axis which can also effectively and efficiently damp the load even though one of the two alternative alignments described herein may be measurably better than the other. In many applications, the primary or principal axis of a mount can be the axis which exhibits the more resilient or softer response to a load on the mount which is parallel to that axis. However, in other applications, a different axis along which the reaction of the mount is stiffer or less resilient may be preferable. As used herein to describe the preferred embodiment of the present invention, the principal axis is an axis of a mount which effectively and efficiently damps the vibrations caused by the reciprocating movement of pistons within the cylinders of an engine.

Although the present invention has been described with particular specificity and illustrated to show a preferred embodiment of the present invention, it should be understood that alternative embodiments are also within its scope.

We claim:

1. A marine propulsion system, comprising:

an engine having a plurality of cylinders, each of said plurality of cylinders having an associated one of a plurality of central axes, said plurality of central axes being disposed within a piston symmetry plane, said engine comprising a crankshaft supported for rotation about a crankshaft axis which is disposed within said piston symmetry plane;

a marine propulsion device connected in torque transmitting relation with said crankshaft, said engine being supported to dispose said piston symmetry plane at a preselected angle relative to a vertical plane, said preselected angle being greater than zero degrees and less than ninety degrees;

a plurality of mounts attached to said engine, each of said plurality of mounts having a primary axis, each of said primary axes being disposed in parallel association with said piston symmetry plane, said engine being supported by said plurality of mounts in a marine vessel, said plurality of mounts comprising first and second mounts attached to a rear portion of said engine and a third mount attached to a front portion of said engine, each of said primary axes being generally parallel to each of said plurality of central axes; and a bearing configured to support a driveshaft of said marine propulsion system and a support axis extending between said bearing and said third mount.

2. The marine propulsion system of claim 1, wherein:

said bearing is supported by a transom of said marine vessel.

3. The marine propulsion system of claim 1, wherein:

said support axis extends through a center of gravity of said engine.

4. The marine propulsion system of claim 1, wherein:

said bearing is a gimbal bearing.

5. The marine propulsion system of claim 1, wherein:

said bearing is generally aligned with said crankshaft axis.

6. The marine propulsion system of claim 1, wherein:

said first and second mounts are spaced apart from and on opposite sides of said piston symmetry plane.

7. The marine propulsion system of claim 1, wherein:

said third mount is disposed within said piston symmetry plane.

8. The marine propulsion system of claim 1, wherein:

said preselected angle is between forty five and fifty five degrees.

9. The marine propulsion system of claim 1, wherein:

said plurality of cylinders comprises four cylinders which are disposed within said piston symmetry plane.

10. A marine propulsion system, comprising:

an engine having a plurality of cylinders, each of said plurality of cylinders having an associated one of a plurality of central axes, said plurality of central axes being disposed within a piston symmetry plane, said engine comprising a crankshaft supported for rotation about a crankshaft axis which is disposed within said piston symmetry plane;

a marine propulsion device connected in torque transmitting relation with said crankshaft, said engine being supported to dispose said piston symmetry plane at a preselected angle relative to a vertical plane, said preselected angle being greater than zero degrees and less than ninety degrees;

a plurality of mounts, each of said plurality of mounts having a primary axis, each of said primary axes being disposed in parallel association with said piston symmetry plane, said mounts being connected between said engine and a marine vessel, said plurality of mounts comprising first and second mounts attached to a rear portion of said engine and a third mount attached to a front portion of said engine; and a bearing supported by a transom of said marine vessel and configured to support a driveshaft of said marine propulsion system and a support axis extending between said bearing and said third mount and proximate a center of gravity of said engine, each of said primary axes being generally parallel to each of said plurality of central axes.

11. The marine propulsion system of claim 10, wherein:

said crankshaft axis intersects said support axis and said bearing.

12. The marine propulsion system of claim 11, wherein:

said first and second mounts are disposed on opposite sides of said piston symmetry plane and said third mount is disposed within said piston symmetry plane.

13. The marine propulsion system of claim 12, wherein:

said preselected angle is between forty five and fifty five degrees.

14. The marine propulsion system of claim 13, wherein:

said plurality of cylinders comprises four cylinders which are disposed within said piston symmetry plane.

15. A marine propulsion system, comprising:

an engine having a plurality of cylinders, each of said plurality of cylinders having an associated one of a plurality of central axes, said plurality of central axes being disposed within a piston symmetry plane, said engine comprising a crankshaft supported for rotation about a crankshaft axis which is disposed within said piston symmetry plane;

a marine propulsion device connected in torque transmitting relation with said crankshaft, said engine being supported to dispose said piston symmetry plane at a preselected angle relative to a vertical plane, said preselected angle being greater than zero degrees and less than ninety degrees;

a plurality of mounts attached to said engine, each of said plurality of mounts having a primary axis, each of said primary axes being disposed in parallel association with said piston symmetry plane, said engine being supported by said plurality of mounts in a marine vessel, said plurality of mounts comprising first and second mounts attached to a rear portion of said engine and a third mount attached to a front portion of said engine, each of said primary axes being generally parallel to each of said plurality of central axes; and a gimbal bearing supported by a transom of said marine vessel and configured to support a driveshaft of said marine propulsion system and a support axis extending between said gimbal bearing and said third mount said support axis extending through a center of gravity of said engine, said gimbal bearing being generally aligned with said crankshaft axis.

16. The marine propulsion system of claim 15, wherein:

said first and second mounts are spaced apart from and on opposite sides of said piston symmetry plane, said third mount being disposed within said piston symmetry plane, said plurality of cylinders comprising four cylinders which are disposed within said piston symmetry plane.

* * * * *